US008590560B2

(12) United States Patent
Komatsu et al.

(10) Patent No.: US 8,590,560 B2
(45) Date of Patent: Nov. 26, 2013

(54) OPENING/CLOSING DEVICE

(75) Inventors: Hiroshi Komatsu, Chiba (JP); Motonobu Ito, Saitama (JP); Kazuhiro Yamanouchi, Chiba (JP); Kenji Hasegawa, Tokyo (JP); Iwao Ito, Kanagawa (JP)

(73) Assignees: Nippon Koei Co., Ltd., Tokyo (JP); Tokyo Metropolitan Sewerage Service Corporation, Tokyo (JP); Kansei Company, Tokyo (JP)

( * ) Notice: Subject to any disclaimer, the term of this patent is extended or adjusted under 35 U.S.C. 154(b) by 232 days.

(21) Appl. No.: 13/147,345

(22) PCT Filed: Feb. 2, 2010

(86) PCT No.: PCT/JP2010/051734
§ 371 (c)(1),
(2), (4) Date: Aug. 18, 2011

(87) PCT Pub. No.: WO2010/090296
PCT Pub. Date: Aug. 12, 2010

(65) Prior Publication Data

US 2011/0297250 A1 Dec. 8, 2011

(30) Foreign Application Priority Data

Feb. 4, 2009 (JP) ..... P2009-023192

(51) Int. Cl.
*F16K 31/18* (2006.01)
*E02B 7/36* (2006.01)

(52) U.S. Cl.
USPC ..... 137/423; 405/87; 405/95; 405/96; 405/106

(58) Field of Classification Search
USPC ..... 137/395–398, 389, 409, 410, 423, 429, 137/115.02, 101.25, 101.27, 101.29, 204, 137/247.19; 251/298–301, 303, 304, 89, 251/89.5, 90; 405/80, 87, 92, 94, 95, 96, 405/106, 113, 99, 100
See application file for complete search history.

(56) References Cited

U.S. PATENT DOCUMENTS 1,039,072 A * 9/1912 Edge ..... 405/94
3,338,057 A * 8/1967 Eckstine ..... 405/95

(Continued)

FOREIGN PATENT DOCUMENTS

JP 2000-345608 12/2000
JP 2004-300895 10/2004

OTHER PUBLICATIONS

International Search Report, PCT/JP2010/051734, Mar. 9, 2010.

*Primary Examiner* — Craig Schneider
*Assistant Examiner* — Craig J Price
(74) *Attorney, Agent, or Firm* — Young & Thompson

(57) ABSTRACT

An opening/closing device includes a gate that receives a flow of a sewage, and can fall toward a downstream side of the flow, a fall prevention unit that prevents the gate from falling by supporting the gate, a support release unit that releases the support for the gate by the fall prevention unit, a first float that is arranged on the upstream side of the gate, and is smaller in specific gravity than the sewage, a surfacing prevention unit that prevents the first float from surfacing, a second float that is arranged on the upstream side of the gate, above the first float, and is smaller in specific gravity than the fluid, and a surfacing-prevention release unit that releases, resulting from surfacing of the second float, the prevention of the surfacing of the first float by the surfacing prevention unit. Further, the support release unit is activated resulting from surfacing of the first float.

6 Claims, 20 Drawing Sheets

(56) References Cited

U.S. PATENT DOCUMENTS

| | | | | | |
|---|---|---|---|---|---|
| 3,543,521 | A * | 12/1970 | Aubert | 405/94 |
| 3,815,161 | A * | 6/1974 | Baker | 4/512 |
| 3,952,522 | A * | 4/1976 | Shettel | 405/96 |
| 3,974,654 | A * | 8/1976 | Mirto, Jr. | 137/409 |
| 4,073,147 | A * | 2/1978 | Nomura | 405/94 |
| 4,114,381 | A * | 9/1978 | Lundh | 405/94 |
| 4,253,202 | A * | 3/1981 | Norris | 405/100 |
| 4,753,550 | A * | 6/1988 | Nylander et al. | 405/94 |
| 5,372,456 | A * | 12/1994 | Langemann | 405/92 |
| 6,623,209 | B1 * | 9/2003 | Waters, Jr. | 405/94 |
| 6,779,947 | B1 * | 8/2004 | Buchanan et al. | 405/99 |
| 7,114,878 | B2 * | 10/2006 | Craig et al. | 405/99 |
| 8,246,272 | B1 * | 8/2012 | Heitz | 405/92 |

* cited by examiner (a)

(b)

(a)

(b)

(a)

(b)

(a)

(b)

(a)

(b)

OPENING/CLOSING DEVICE

TECHNICAL FIELD

The present invention relates to an opening/closing device used in a flow passage such as a sewage system.

BACKGROUND ART

An opening/closing device used in a flow passage such as a sewage system has conventionally been known (refer to Japanese Patent Application Laid-Open No. 2004-300895), for example). This opening/closing device dams the flow passage while a valve is closed. Then, garbage is accumulated downstream in the flow passage. If the water level in the flow passage exceeds a predetermined water level due to a rainfall or the like, the valve is brought into an open state, water flows to the downstream of the flow passage, and the accumulated garbage can be flown away. In other words, the flow passage can be cleaned.

It should be noted that a float is used to detect whether the water level of the flow passage exceeds the predetermined water level or not (refer to FIG. 1 of Japanese Patent Application Laid-Open No. 2004-300895), for example).

Moreover, there is known such a configuration that frame columns are erected on left and right sides of the valve, lock mechanisms are used to lock the valve to the left and right frame columns so as to prevent the valve from opening (refer to FIGS. 5 and 6 of Japanese Patent Application Laid-Open No. 2004-300895), for example). In this case, the float and the lock mechanisms are operationally associated with each other, and if the water level in the flow passage reaches or exceeds the predetermined water level, the lock by the lock mechanism is released, resulting in the valve opening. The left and right lock mechanisms are connected with each other in order to simultaneously release the lock in the lock mechanisms respectively provided on the left and right frame columns.

It is further known that, if the water level decreases while the valve is opened, the valve is returned to the closed state by a spring (refer to FIG. 1 of Japanese Patent Application Laid-Open No. 2004-300895), for example). In this case, there is provided such a configuration that the force generated by the spring increases in the state in which the valve is open.

DISCLOSURE OF THE INVENTION

However, if the water level slowly increases, the float will operate slowly. The lock mechanism operationally associated with the float then operates slowly, and the lock is not released quickly. There thus poses a problem that the valve does not open quickly.

It is therefore an object of the present invention to quickly open the valve.

According to the present invention, an opening/closing device includes: a gate that receives a flow of a fluid, and can fall toward a downstream side of the flow; a fall prevention unit that prevents the gate from falling by supporting the gate; a support release unit that releases the support for the gate by the fall prevention unit; a first float that is arranged on the upstream side of the gate, and is smaller in specific gravity than the fluid; a surfacing prevention unit that prevents the first float from surfacing; a second float that is arranged on the upstream side of the gate, is arranged above the first float, and is smaller in specific gravity than the fluid; and a surfacing-prevention release unit that releases, resulting from surfacing of the second float, the prevention of the surfacing of the first float by the surfacing prevention unit, wherein the support release unit is activated resulting from surfacing of the first float.

According to the thus constructed opening/closing device, a gate receives a flow of a fluid, and can fall toward a downstream side of the flow. A fall prevention unit prevents the gate from falling by supporting the gate. A support release unit releases the support for the gate by the fall prevention unit. A first float is arranged on the upstream side of the gate, and is smaller in specific gravity than the fluid. A surfacing prevention unit prevents the first float from surfacing. A second float is arranged on the upstream side of the gate, is arranged above the first float, and is smaller in specific gravity than the fluid. A surfacing-prevention release unit releases, resulting from surfacing of the second float, the prevention of the surfacing of the first float by the surfacing prevention unit. The support release unit is activated resulting from surfacing of the first float.

According to the opening/closing device of the present invention, the fall prevention unit may support a surface on the downstream side of the gate.

According to the opening/closing device of the present invention, the support release unit may release the support for the gate by pulling the fall prevention unit toward an outside of the flow.

According to the present invention, the opening/closing device may include a suspension member that suspends the first float, and include a portion which ascends resulting from the surfacing of the first float, wherein the surfacing prevention unit may include: an abutting portion that is located above the suspension member, and abuts against the suspension member if the ascending portion of the suspension member ascends; and a fixing portion which rotatably fixes the abutting portion to a portion which is stationary with respect to the flow.

According to the opening/closing device of the present invention, the surfacing prevention unit may include a rotatable portion which can rotate about the fixing portion, wherein the abutting portion rotates by an angle by which the rotatable portion rotates; and the surfacing-prevention release unit may include a drive unit that moves the rotatable portion resulting from the surfacing of the second float.

According to the present invention, the opening/closing device may include a descending portion that is coupled to the suspension member, and descends resulting from the ascent of the ascending portion of the suspension member, wherein: the support release unit may release the support for the gate by pulling the fall prevention unit toward an outside of the flow; and the support release unit may be coupled to the descending portion, and pull the fall prevention unit toward the outside of the flow in response to a descent of the descending portion.

BEST MODE FOR CARRYING OUT THE INVENTION

Figure 1:
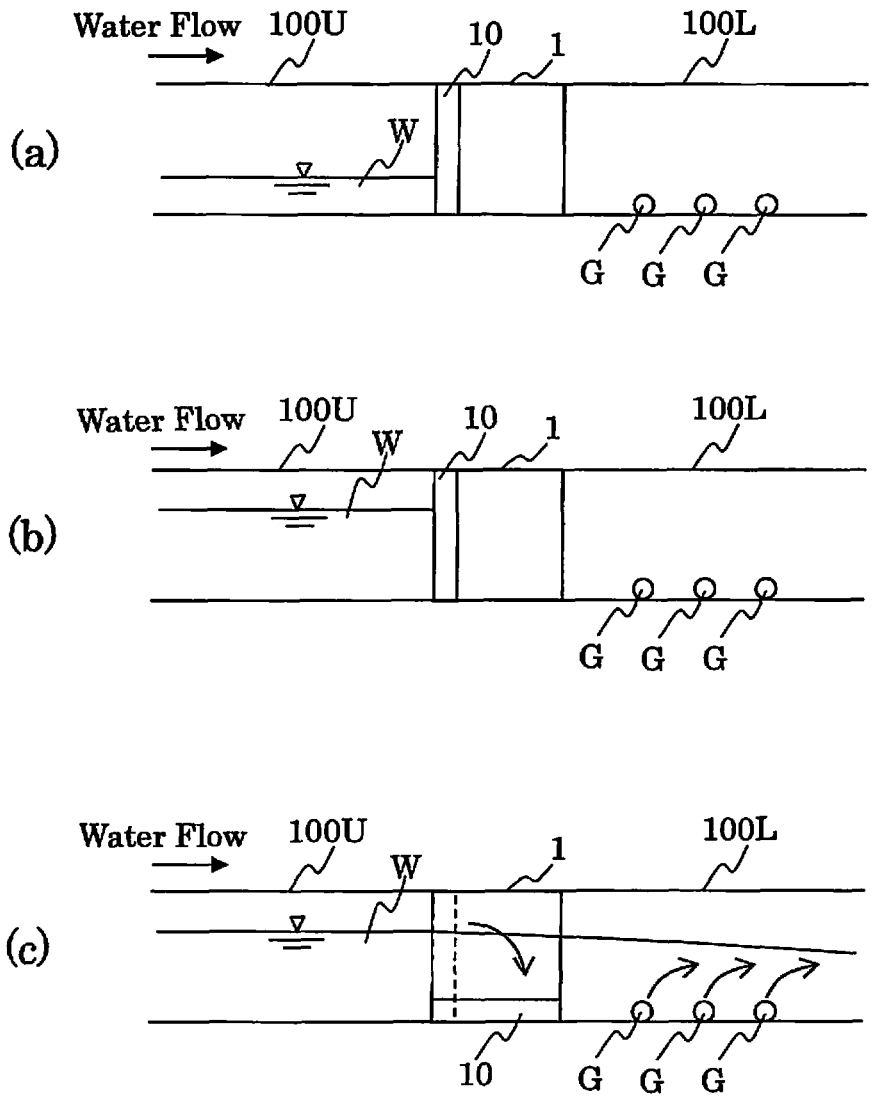
FIGS. 1(*a*) to 1(*c*) include diagrams describing an overview of an operation if an opening/closing device 1 according to an embodiment of the present invention is provided in sewers 100U, 100L, a diagram if the water level of the sewer 100U is low (FIG. 1(*a*)), a diagram if the water level of the sewer 100U is increasing (FIG. 1(*b*)), and a diagram after the water level of the sewer 100U reaches or exceeds a predetermined level (FIG. 100(*c*))

FIGS. 1(*a*) to 1(*c*) include diagrams describing an overview of an operation if an opening/closing device 1 according to an embodiment of the present invention is provided in sewers 100U, 100L, a diagram if the water level of the sewer 100U is low (FIG. 1(*a*)), a diagram if the water level of the sewer 100U is increasing (FIG. 1(*b*)), and a diagram after the water level of the sewer 100U reaches or exceeds a predetermined level (FIG. 100(*c*)). Though a gate 10 of the opening/closing device 1 is shown, other components of the opening/closing device 1 are omitted in FIGS. 1(*a*) to (*c*).

First, the sewer 100U is located on the upstream side, and the sewer 100L is located on the downstream side. The opening/closing device 1 is installed between the sewer 100U and the sewer 100L through a manhole, which is not shown. The water level of a sewage W flowing in the sewer 100U is usually low (refer to FIG. 1(*a*)). On this occasion, the gate 10 is in an upright state, and receives the sewage W (a type of fluid) flowing through the sewer 100U. The sewage W is then dammed by the gate 10, and the sewage W does not flow in the sewer 100L on the downstream side. Garbage G is then accumulated in the sewer 100L.

On this occasion, the water level of the sewage W flowing in the sewer 100U increases due to a rainfall or the like (refer to FIG. 1(*b*)). Then, if the water level of the sewer 100U reaches or exceeds the predetermined level (refer to FIG. 1(*b*)), the gate 10 falls down, and the sewage W flows from the sewer 100U to the sewer 100L. As a result, the garbage G accumulated in the sewer 100L is flown away, and the sewer 100L can be cleaned.

Figure 2:
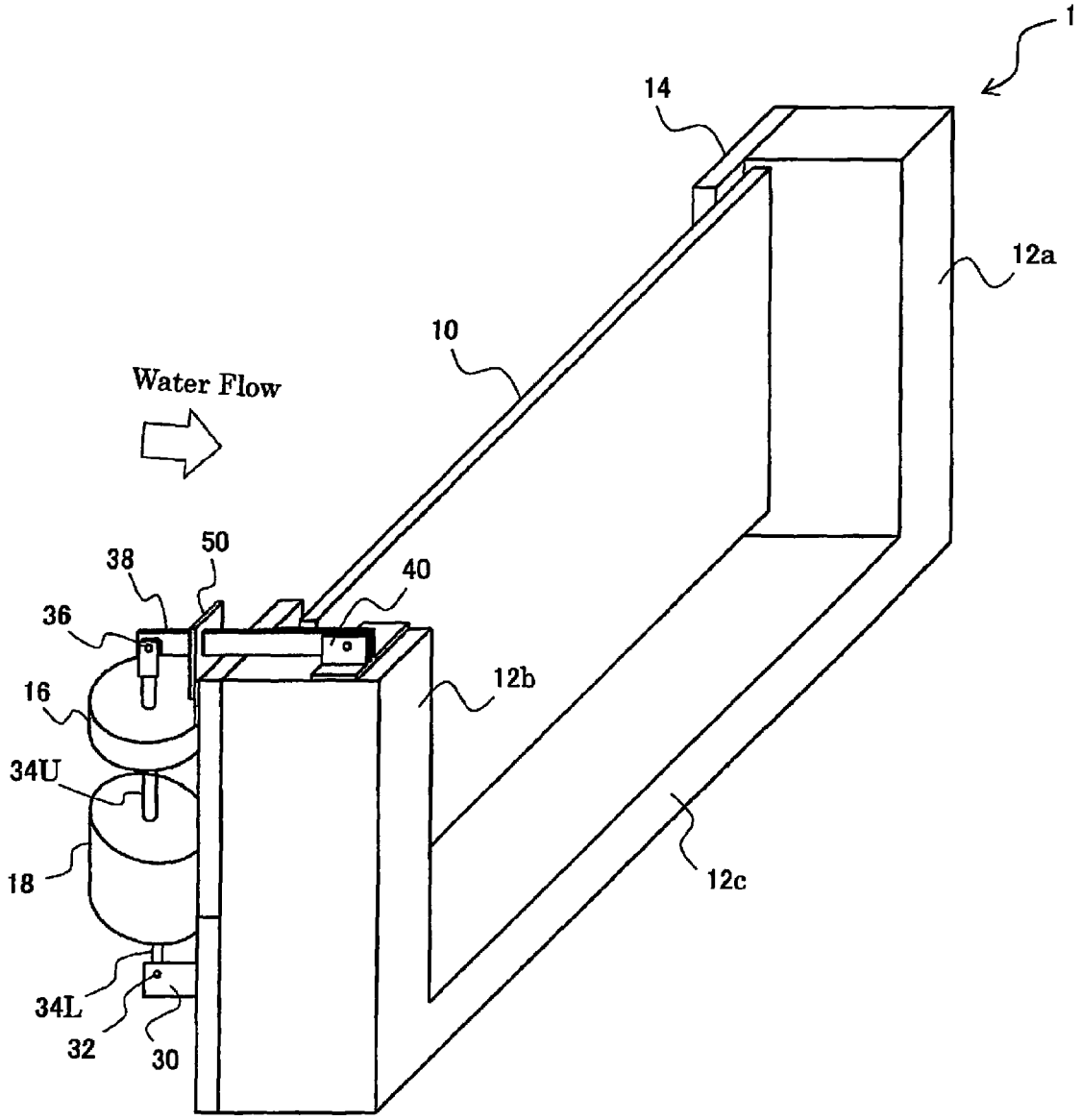
FIG. 2 is a perspective view of the opening/closing device 1 (in a state in which the gate 10 is standing upright)
Figure 3:
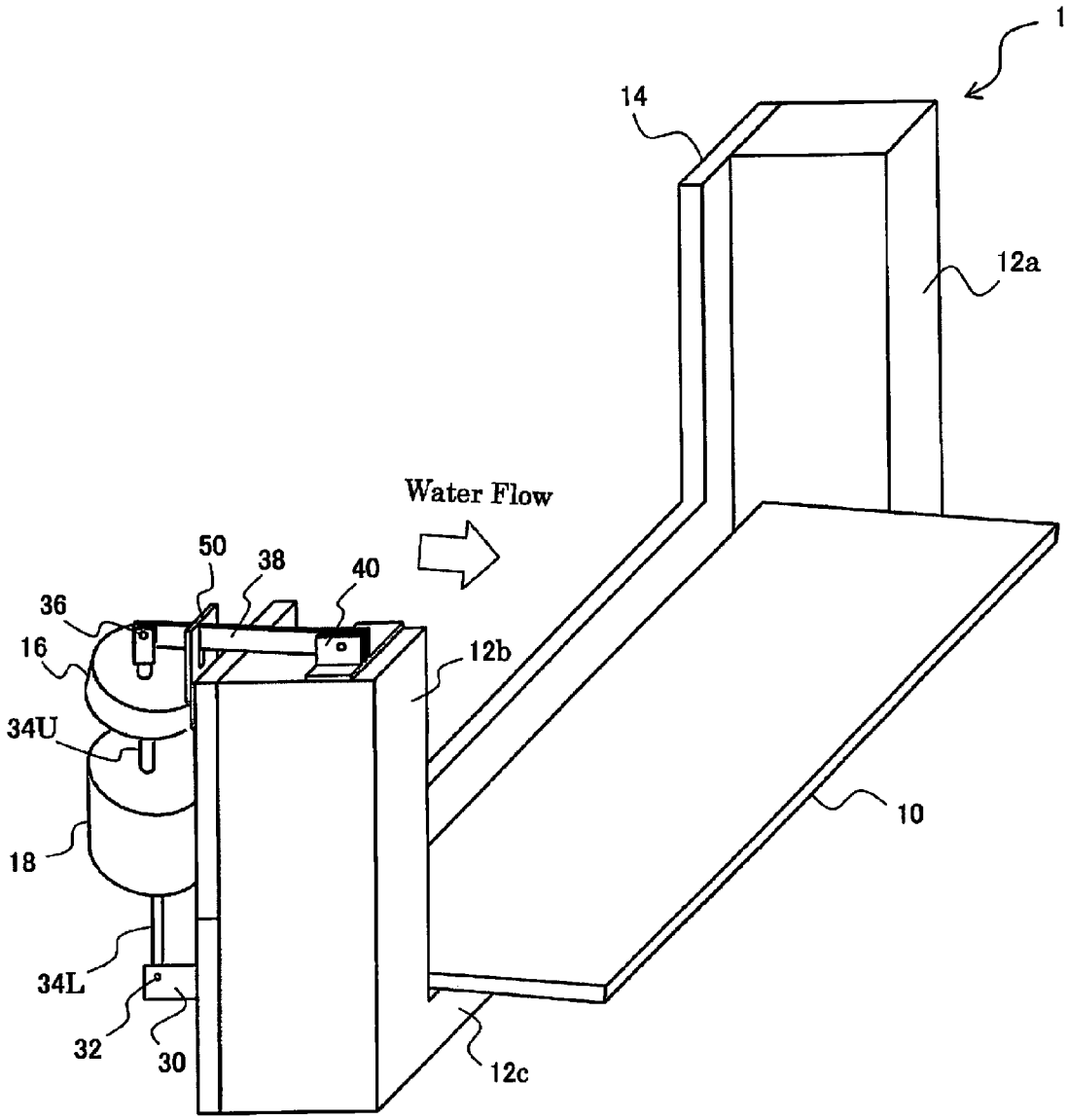
FIG. 3 is a perspective view of the opening/closing device 1 (in a fallen down state of the gate 10)
Figure 4:
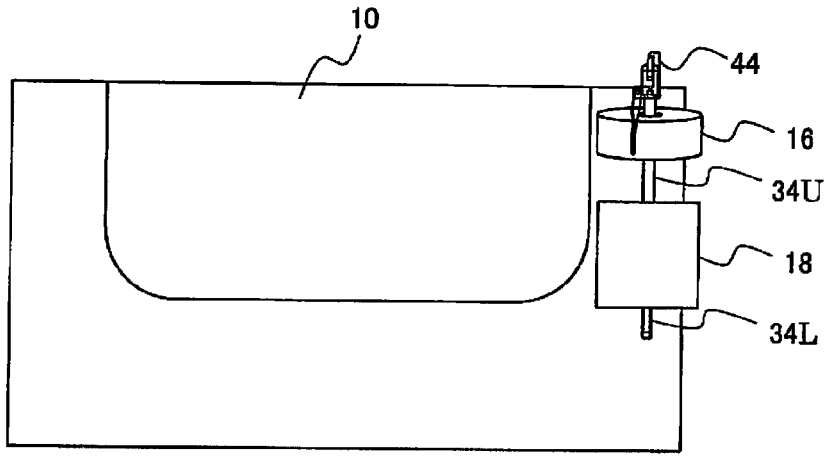
FIGS. 4(*a*) and 4(*b*) include a drawing of the opening/closing device 1 viewed from the upstream side (FIG. 4(*a*)), and a drawing of the opening/closing device 1 viewed from the downstream side (FIG. 4(*b*))
Figure 4:
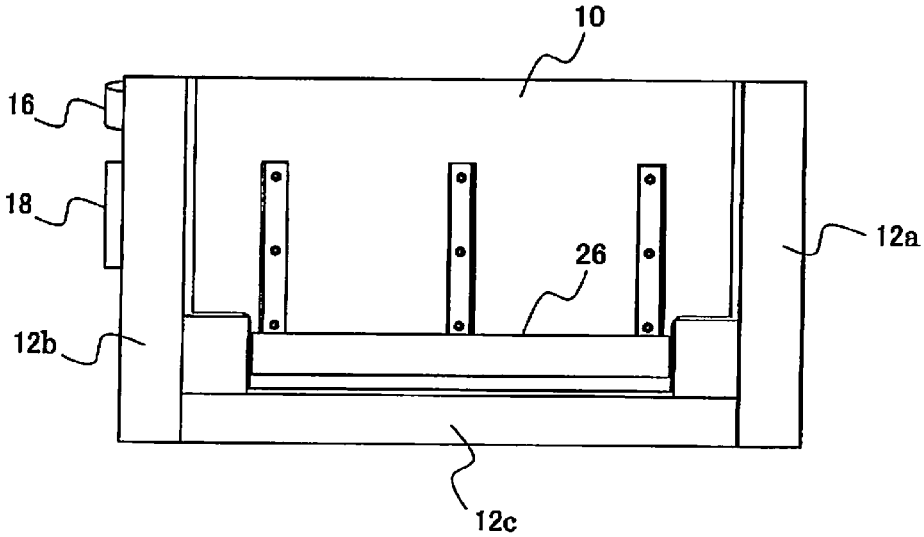

FIG. 2 is a perspective view of the opening/closing device 1 (in a state in which the gate 10 is standing upright). FIG. 3 is a perspective view of the opening/closing device 1 (in a fallen down state of the gate 10). FIGS. 4(*a*) and 4(*b*) include a drawing of the opening/closing device 1 viewed from the upstream side (FIG. 4(*a*)), and a drawing of the opening/closing device 1 viewed from the downstream side (FIG. 4(*b*)).

The opening/closing device 1 includes the gate 10, frame columns 12*a*, 12*b*, a bottom portion 12*c*, a plate 14, a first float 18, a second float 16, a float support 30, a bottom fulcrum 32, a lower float insert 34L, an upper float insert 34U, a top fulcrum 36, a suspension member 38, a suspension fulcrum 40, and a plate 50.

The gate 10 is surrounded by the frame columns 12*a*, 12*b* standing by the gate 10, and the bottom portion 12*c* arranged at the bottom of the gate 10, and is further partially covered by the plate 14. The gate 10 receives and dams the water flow while standing upright (refer to FIG. 2). However, if the water level of the water flow increases, and the first float 18 and the second float 16 surface, the gate 10 falls toward the downstream side, and the fluid such as the sewage W flows downstream (refer to FIG. 3).

It should be noted that the left side is the upstream side, and the right side is the downstream side in FIGS. 2, and 3. Moreover, it is assumed that the specific gravities of the first float 18 and the second float 16 are smaller than the specific gravity of the fluid which the gate 10 is receiving while standing upright. Moreover, the first float 18 and the second float 16 are arranged on the upstream side of the gate 10. Further, the second float 16 is arranged above the first float 18.

It should be noted that the float support 30 is arranged below the first float 18 and is fixed to the frame column 12*b*. The lower float insert 34L is fixed to the bottom fulcrum 32 of the float support 30. The lower float insert 34L extends in the vertical direction, and is inserted into the first float 18 from the bottom. The first float 18 can move up and down along the lower float insert 34L. The upper float insert 34U passes through the second float 16, and is inserted into the first float 18 from the top. The suspension member 38 is a member for suspending the first float 18 where the upper float insert 34U is fixed to the top fulcrum 36 thereof. The suspension member 38 is fixed to the frame column 12*b* by the suspension fulcrum 40. If the first float 18 does not surface, the upper float insert 34U does not ascend, and the suspension member 38 maintains horizontal (refers to FIGS. 8 and 9). If the first float 18 surfaces, the upper float insert 34U also ascends, and the suspension member 38 rotates about the suspension fulcrum 40 so that the top fulcrum 36 ascends (refer to FIG. 10, for example).

A surfacing prevention unit 44 shown in FIG. 4(*a*) will later be described referring to FIGS. 5 and 6.

The plate 50 is fixed to a top of the frame column 12*b*.

Figure 5:
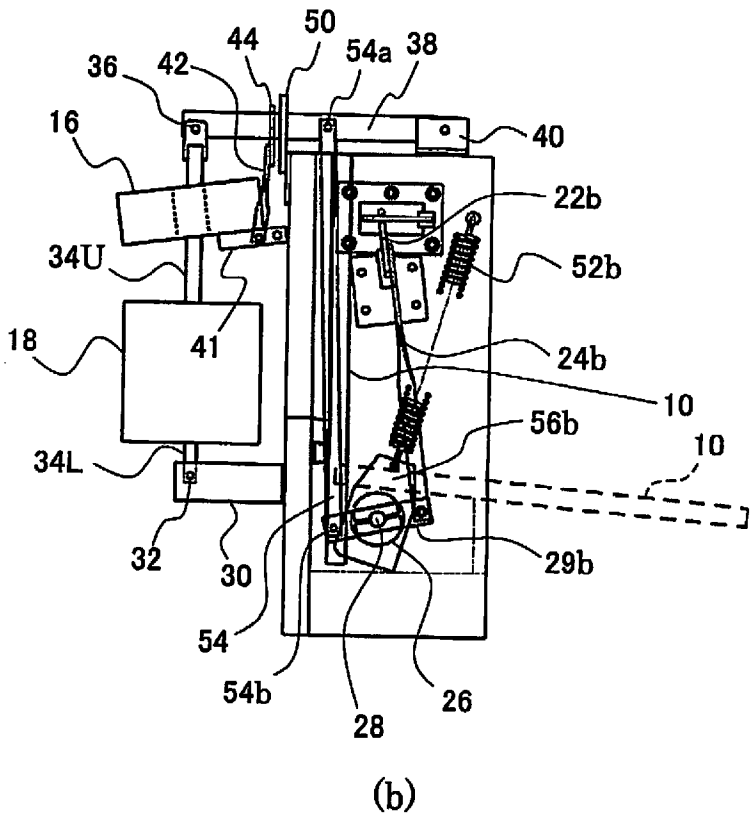
FIGS. 5(*a*) and 5(*b*) are side views of the opening/closing device 1, and are a left side view (FIG. 5(*a*)) and a right side view (FIG. 5(*b*)) from the upstream standpoint.
Figure 5:
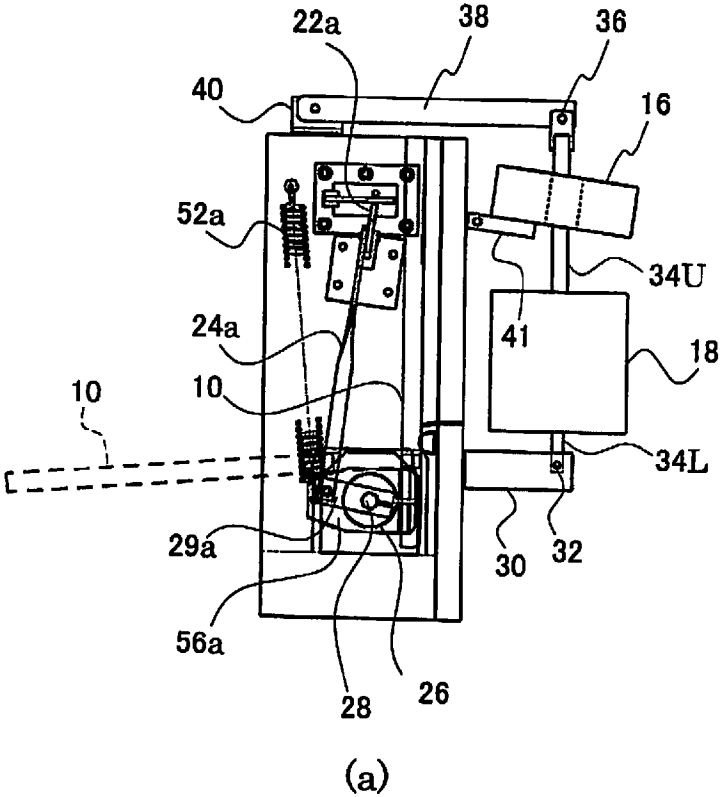

FIGS. 5(*a*) and 5(*b*) are side views of the opening/closing device 1, and are a left side view (FIG. 5(*a*)) and a right side view (FIG. 5(*b*)) from the upstream standpoint. FIG. 6 is an enlarged front view of a neighborhood of the surfacing prevention unit 44 of the opening/closing device 1. FIG. 7 is a plan view transparently showing neighborhoods of fall prevention units 20*a*, 20*b* while the gate 10 is standing upright.

The opening/closing device 1 includes, in addition to the components as described above, the fall prevention units 20*b*, 20*a*, a first support release unit 22*b*, a second support release unit 22*a*, the surfacing prevention unit 44, a second-float support beam 41, a surfacing-prevention release unit 42, a gate rotation shaft 26, a common rotation shaft 28, rotation units 29*b*, 29*a*, descending portions 24*b*, 24*a*, a first spring 52*a*, a second spring (second force generation unit) 52*b*, a link 54, and rotation bodies 56*a*, 56*b*.

A fall prevention unit and a support release unit according to claim 1 respectively correspond to the fall prevention unit 20*b*, and the first support release unit 22*b*.

The gate 10 can fall about the hollow gate rotation shaft 26 (refer to FIG. 13) as a center of rotation (rotational axis). The gate 10 in the fallen state is shown by dotted lines in FIGS. 5(*a*) and (*b*).

Referring to FIG. 7, the fall prevention units 20*b*, 20*a* are in contact with a surface 10*a* on the downstream side, thereby exerting forces against the water flow on the gate 10. In other words, the fall prevention units 20*b*, 20*a* support the surface 10*a* on the downstream side of the gate 10. The fall prevention units 20*b*, 20*a* prevent the gate 10 from falling toward the downstream side by supporting the gate 10. The fall prevention unit 20*b* is arranged on the right side, and the fall prevention unit 20*a* is arranged on the left side viewing from the upstream side.

Referring to FIG. 7, the first support release unit 22*b* and the second support release unit 22*a* are symmetrical in the horizontal direction viewed from the upstream side (and also viewed from the downstream side).

Figure 12:
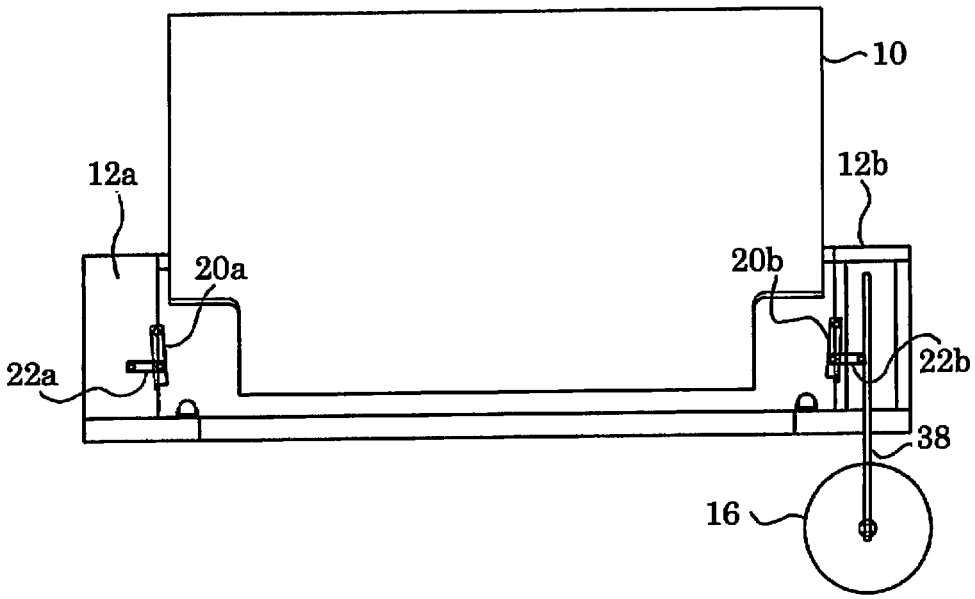
FIG. 12 is a plan view transparently viewing neighborhoods of the fall prevention units 20*a*, 20*b* while the gate 10 is fallen down.

The first support release unit 22*b*, by pulling the fall prevention unit 20*b* toward the outside of the water flow (flow) (right side in FIG. 7), detaches a point at which the fall prevention unit 20*b* is in contact with the gate 10 from the gate 10, thereby releasing the support for the gate 10 by the fall prevention unit 20*b* (refer to FIG. 12).

The second support release unit 22*a*, by pulling the fall prevention unit 20*a* toward the outside of the water flow (flow) (left side in FIG. 7), detaches a point at which the fall prevention unit 20*a* is in contact with the gate 10 from the gate 10, thereby releasing the support for the gate 10 by the fall prevention unit 20*a* (refer to FIG. 12).

The surfacing-prevention release unit 42, the surfacing prevention unit 44, and the plate 50 are omitted from the view for the sake of illustration in FIG. 5(*a*). Further, the link 58 (shown in FIG. 15(*a*)) is also omitted from the view in FIG. 5(*a*), and the first spring 52 is illustrated so as to be fixed to the rotation unit 56*a*.

The surfacing prevention unit 44 prevents the first float 18 from surfacing.

Figure 6:
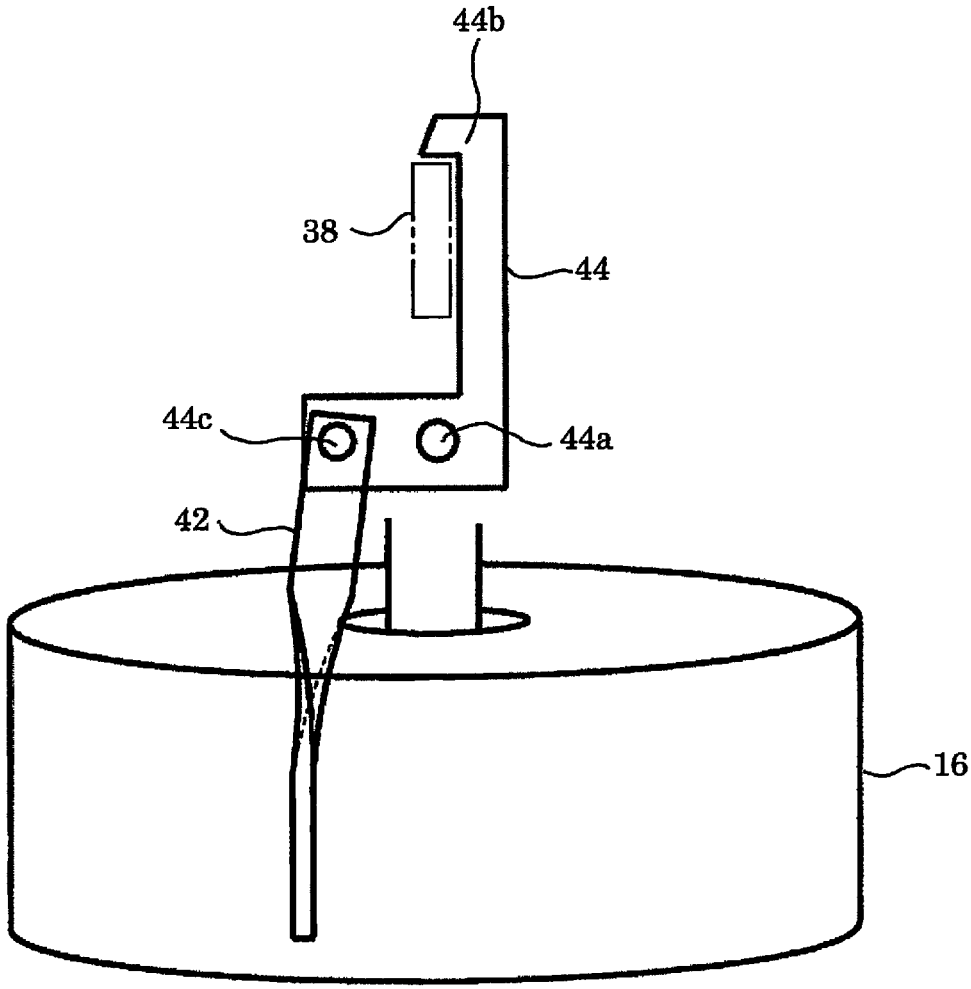
FIG. 6 is an enlarged front view of a neighborhood of the surfacing prevention unit 44 of the opening/closing device 1.
Figure 7:
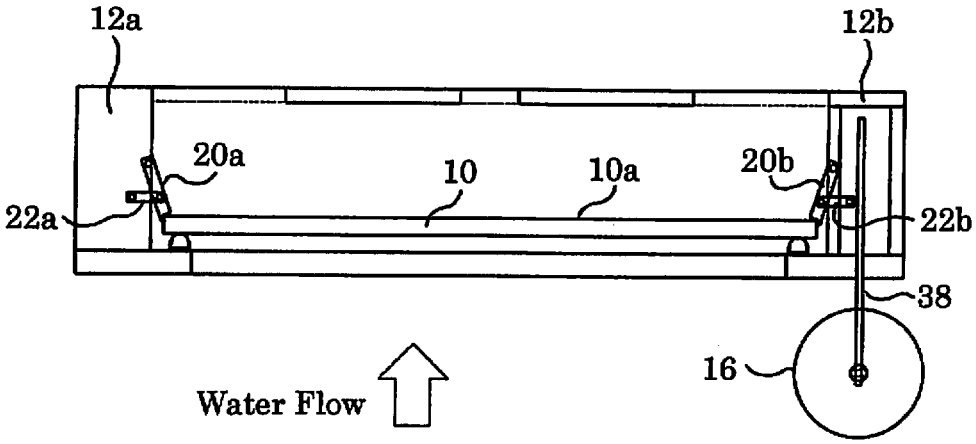
FIG. 7 is a plan view transparently showing neighborhoods of fall prevention units 20*a*, 20*b* while the gate 10 is standing upright.

Referring to FIG. 6, the surfacing prevention unit 44 includes an abutting portion 44*b*, a fixing portion 44*a*, and a rotatable portion 44*c*.

The abutting portion 44*b* is located above the suspension member 38, and abuts against the suspension member 38 if an ascending portion (a portion of the suspension member 38 directly below the abutting portion 44*b*) of the suspension member 38 ascends. If the first float 18 surfaces, the ascending portion of the suspension member 38 also ascends. However, the suspension member 38 abuts against the abutting portion 44*b*, and the first float 18 thus cannot surface.

The fixing portion 44*a* fixes the abutting portion 44*b* to a portion which is stationary with respect to the flow (plate 50, for example). It should be noted that the abutting portion 44*b* can rotate about the fixing portion 44*a*. It should be noted that the configuration that the fixing portion 44*a* is fixed to the plate 50 is not illustrated in other drawings.

The rotatable portion 44*c* is located approximately as high as the fixing portion 44*a*, and can rotate about the fixing portion 44*a*.

It should be noted that the abutting portion 44*b* and the rotatable portion 44*c* are integrated with each other, and the abutting portion 44*b* rotates about the fixing portion 44*a* by an angle by which the rotatable portion 44*c* rotates about the fixing portion 44*a*.

The second-float support beam 41 is fixed to the frame column 12*b* at the fulcrum 41*a* (refer to FIG. 8), and supports the second float 16. The second-float support beam 41 can rotate about the fulcrum 41*a*.

Figure 8:
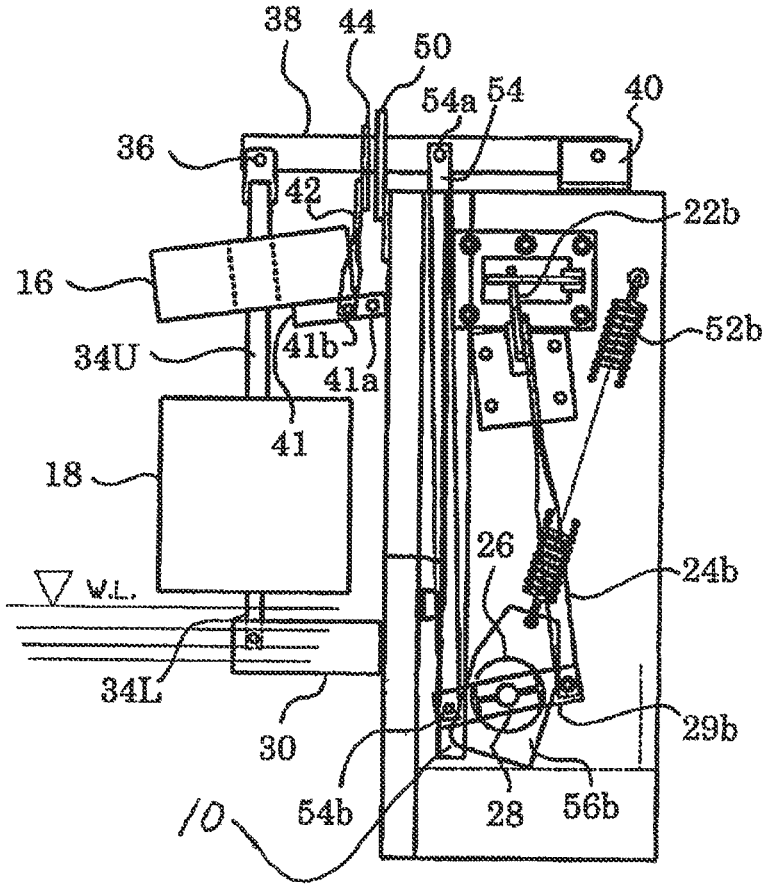
FIG. 8 is a right side view of the opening/closing device 1 from the upstream standpoint if the water level (denoted by W.L.) of the sewage W is low.

The surfacing-prevention release unit (drive unit) 42 is connected rotatably to a connection point 41*b* of the second-float support beam 41 (arranged on the upstream side with respect to the fulcrum 41*a*) (refer to FIG. 8). If the second float 16 surfaces, the second-float support beam 41 rotates about the fulcrum 41*a*, and the connection point 41*b* ascends. Then, the surfacing-prevention release unit (drive unit) 42 ascends, and pushes the rotatable portion 44*c* upward, and the rotatable portion 44*c* rotates about the fixing portion 44*a*. The abutting portion 44*b* moves from above the suspension member 38 (refer to FIG. 11), and nothing is present for preventing the portion of the suspension member 38 immediately below the abutting portion 44*b* from ascending. The surfacing-prevention release unit (drive unit) 42 releases, resulting from surfacing of the second float 16, the prevention of the surfacing of the first float 18 by the surfacing prevention unit 44.

Figure 13:
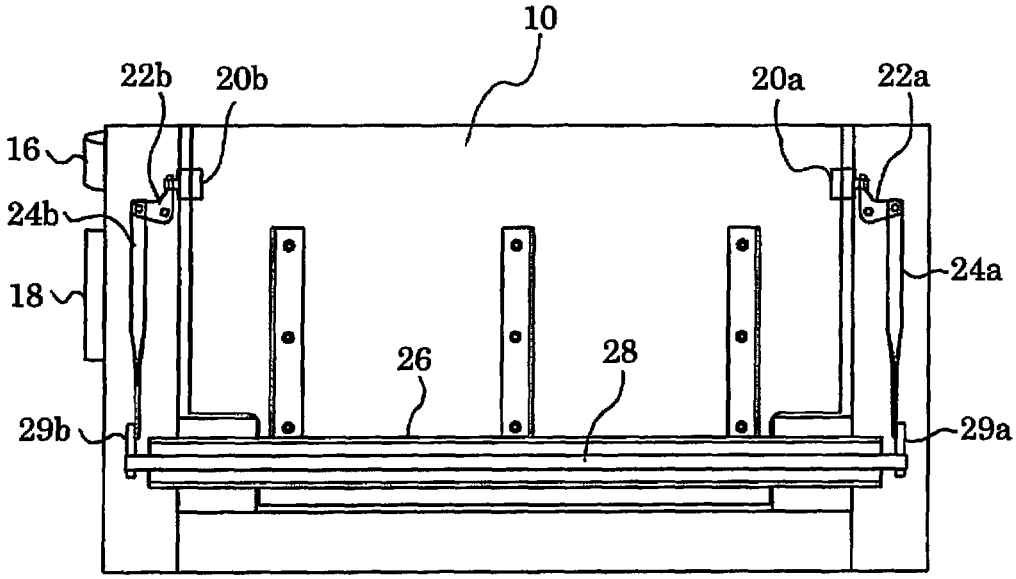
FIG. 13 is a drawing of the opening/closing device 1 viewed from the downstream side, transparently shows the common rotation shaft 28, and further shows the first release action unit (rotation unit 29*b* and descending portion 24*b*), the second release action unit (rotation unit 29*a* and descending portion 24*a*), the falling prevention units 20*b*, 20*a*, the first support release unit 22*b*, and the second support release unit 22*a;*

The common rotation shaft 28 is arranged inside the hollow gate rotation shaft 26, and extends in the same direction as the gate rotation shaft 26 referring to FIG. 13.

Rotation units 29*b*, 29*a* are fixed to the common rotation shaft 28, and rotate along with the common rotation shaft 28. For example, if the rotation unit 29*b* rotates, the common rotation shaft 28 rotates according to the rotation. If the common rotation shaft 28 rotates, the rotation unit 29*a* rotates.

The link 54 is connected at its one end 54*a* to the suspension member 38, and is connected at a neighborhood 54*b* of the other end to the rotation unit 29*b*.

The descending portion 24*b* is rotatably fixed to an end (on the opposite side of the neighborhood 54*b* of the other end) of rotation unit 29*b*. If the rotation unit 29*b* rotates clockwise in FIG. 5(*b*), the descending portion 24*b* descends accordingly.

It should be noted that the descending portion 24*b* is coupled to the suspension member 38 via the link 54 and the rotation unit 29*b*. As the ascending portion of the suspension member 38 (the portion of the suspension member 38 immediately below the abutting portion 44*b*) ascends, the rotation unit 29*b* rotates clockwise in FIG. 5(*b*), and the descending portion 24*b* descends.

The descending portion 24*b* is rotatably fixed to the end of the rotation unit 29*a*. The rotation unit 29*a* rotates counterclockwise in FIG. 5(*a*) (which corresponds to the clockwise rotation in FIG. 5(*b*)), the descending portion 24*a* descends accordingly.

The rotation unit 29*b* and the descending portion 24*b* form a first release action unit. The first release action unit causes the descending portion 24*b* to descend while rotating (rotating clockwise in FIG. 5(*b*)) the common rotation shaft 28 by the rotation unit 29*b*, thereby pulling the first support release unit 22*b* to activate the first support release unit 22*b*.

Referring to FIG. 13, the first support release unit 22*b* is in a shape bent approximately by the right angle, is coupled to the descending portion 24*b* at a horizontal portion thereof, is coupled to the fall prevention unit 20*b* at a portion extending vertically, and can rotate about the portion bent by the right angle.

Thus, if the descending portion 24*b* is caused to descend, thereby pulling the first support release unit 22*b*, the first support release unit 22*b* rotates counterclockwise in FIG. 13, thereby pulling the fall prevention unit 20*b*, resulting in the activation of the first support release unit 22*b*.

The rotation unit 29*a* and the descending portion 24*a* form a second release action unit. In the second release action unit, as the common rotation shaft 28 rotates (rotates counterclockwise in FIG. 5(*a*)), the rotation unit 29*a* rotates to cause the descending portion 24*a* to descend, thereby pulling the second support release unit 22*a*, resulting in the activation of the second support release unit 22*a*.

Referring to FIG. 13, the second support release unit 22*a* is in a shape bent approximately by the right angle, is coupled to the descending portion 24*a* at a horizontal portion thereof, is coupled to the fall-prevention portion 20*a* at a portion extending vertically, and can rotate about the portion bent by the right angle.

Thus, if the descending portion 24*a* is caused to descend, thereby pulling the second support release unit 22*a*, the second support release unit 22*a* rotates clockwise in FIG. 13, thereby pulling the fall prevention unit 20*a*, resulting in the activation of the second support release unit 22*a*.

It should be noted that the first release action unit (rotation unit 29*b* and descending portion 24*b*) and the second release action unit (rotation unit 29*a* and descending portion 24*a*) are symmetrical in horizontal direction viewed from the upstream side (and also viewed from the downstream side).

A description will later be given of the first spring 52*a*, the second spring (second force generation unit) 52*b*, and the rotation bodies 56*a*, 56*b* referring to FIGS. 15(*a*), (*b*) and the like.

A description will now be given of an operation (until the fall of the gate 10 after the water increases from a low level to a high level) of the embodiment of the present invention.

The water level of the sewage W is usually low.

FIG. 8 is a right side view of the opening/closing device 1 from the upstream standpoint if the water level (denoted by W.L.) of the sewage W is low. Referring to FIG. 8, if the water level (denoted by W.L.) of the sewage W is low, the gate 10 is supported by the falling-prevention units 20*b*, 20*a*, and is thus remains upright as described referring to FIGS. 5(*a*), (*b*).

Then, the water level of the sewage W increases due to a rainfall or the like.

Figure 9:
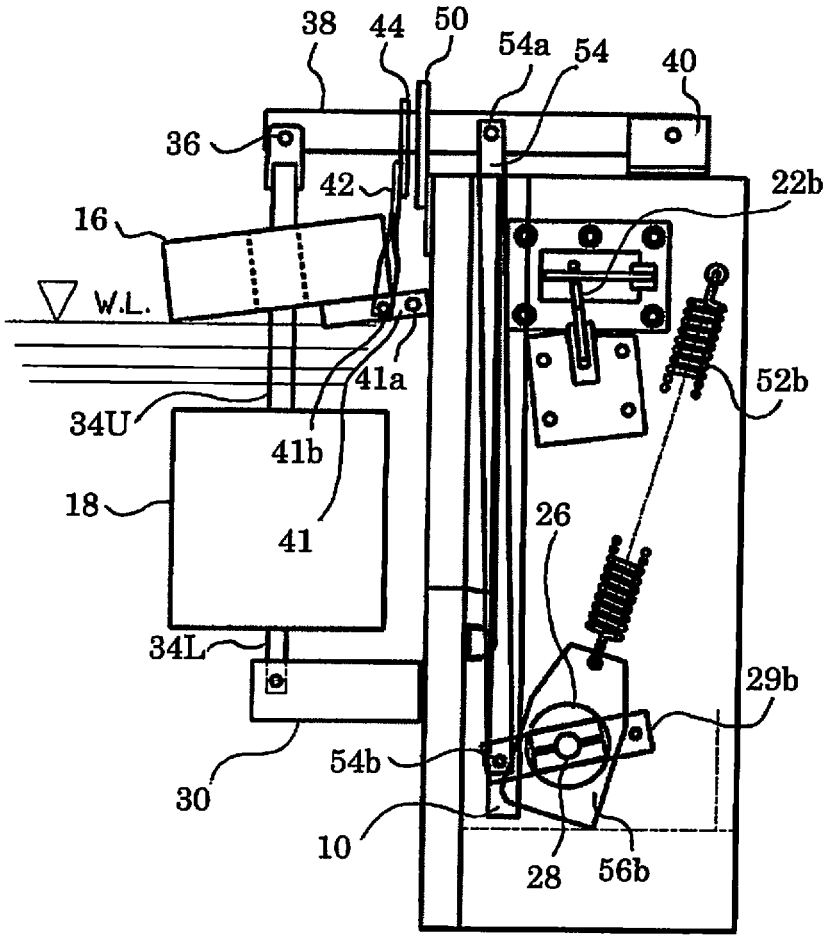
FIG. 9 is a right side view of the opening/closing device 1 if the water level (denoted by W.L.) of the sewage W increases, and exceeds the top end of the first float 18, but the second float 16 is approximately above the water level of the sewage W.

FIG. 9 is a right side view of the opening/closing device 1 if the water level (denoted by W.L.) of the sewage W increases, and exceeds the top end of the first float 18, but the second float 16 is approximately above the water level of the sewage W. It should be noted that the descending portion 24*b* is omitted in FIG. 9.

The first float 18 is submerged in the sewage W, the specific gravity of the first float 18 is smaller than the specific gravity of the sewage W, the first float 18 should thus surface, and the top end of the first float 18 should exceed the water level of the sewage W. However, the first float 18 does not surface.

If the first float 18 surfaces, the upper float insert 34U also ascends, and the suspension member 38 rotates about the suspension fulcrum 40 (clockwise in FIG. 9) so that the top fulcrum 36 ascends. However, referring to FIG. 6, the abutting portion 44*b* is arranged above the suspension member 38. As a result, even if the suspension member 38 tries to rotate about the suspension fulcrum 40, the suspension member 38 abuts against the abutting portion 44*b*, and cannot rotate any further, resulting in preventing the suspension member 38 from rotating, and the first float 18 does not surface accordingly.

Then, the water level of the sewage W increases further.

Figure 10:
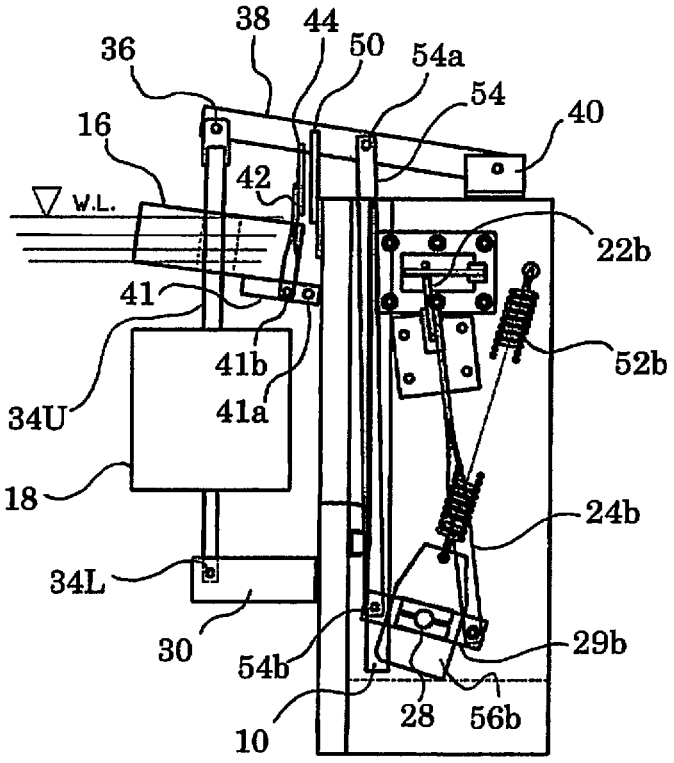
FIG. 10 is a right side view of the opening/closing device 1 if the water level (denoted by W.L.) of the sewage W increases further, and the second float 16 surfaces.

FIG. 10 is a right side view of the opening/closing device 1 if the water level (denoted by W.L.) of the sewage W increases further, and the second float 16 surfaces. It should be noted that the gate rotation shaft 26 is omitted in FIG. 10.

The second float 16 is formed of the same material as the first float 18, and the outer diameters thereof are the same. However, the second float 16 is thinner in the vertical direction compared with the first float 18. Thus, the second float 16 is lighter than the first float 18. This means that if the second float 16 is partially submerged in the sewage W, it tends to surface quickly.

Figure 11:
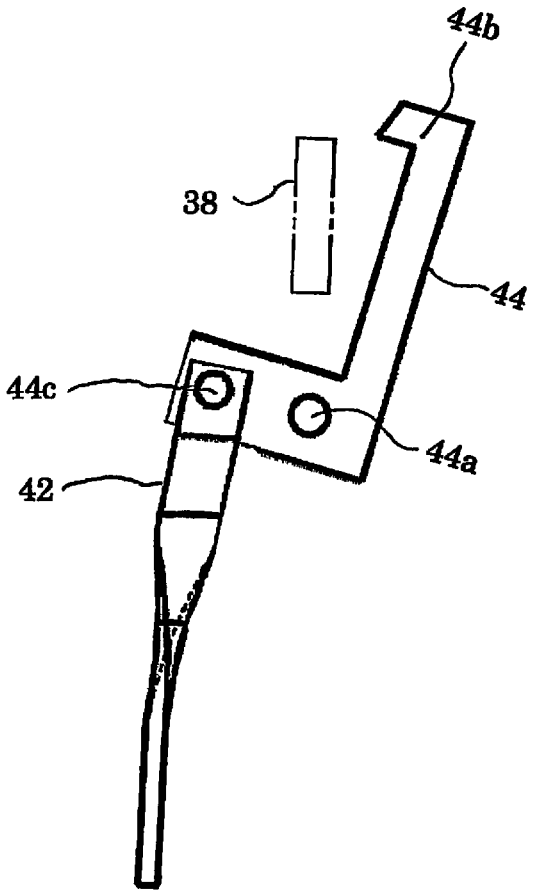
FIG. 11 is an enlarged front view of a neighborhood of the surfacing prevention unit 44 of the opening/closing device 1 if the surfacing prevention unit 44 rotates.

FIG. 11 is an enlarged front view of a neighborhood of the surfacing prevention unit 44 of the opening/closing device 1 if the surfacing prevention unit 44 rotates.

If the second float 16 is partially submerged in the sewage W, and surfaces quickly, the second-float support beam 41 rotates about the fulcrum 41*a*, and the connection point 41*b* ascends. Then, the surfacing-prevention release unit (drive unit) 42 ascends, and pushes the rotatable portion 44*c* upward, and the rotatable portion 44*c* rotates about the fixing portion 44*a*. The abutting portion 44*b* moves from above the suspension member 38 (refer to FIG. 11), and nothing is present for preventing the portion of the suspension member 38 immediately below the abutting portion 44*b* from ascending.

On this occasion, the first float 18 is totally submerged in the sewage W, and is receiving a large buoyant force, and the first float 18 tends to surface quickly. As a result, suspension member 38 rotates about the suspension fulcrum 40 (clockwise in FIG. 10).

Then, the link 54 ascends, thereby descending the descending portion 24*b* while the rotation unit 29*b* is rotating the common rotation shaft 28 (clockwise in FIG. 10). If the descending portion 24*b* is caused to descend, thereby pulling the first support release unit 22*b*, the first support release unit 22*b* rotates counterclockwise in FIG. 13, thereby pulling the fall prevention unit 20*b*, resulting in the activation of the first support release unit 22*b*. The fall prevention unit 20*b* is thus detached from the gate 10 (refer to FIG. 12).

FIG. 13 is a drawing of the opening/closing device 1 viewed from the downstream side, transparently shows the common rotation shaft 28, and further shows the first release action unit (rotation unit 29*b* and descending portion 24*b*), the second release action unit (rotation unit 29*a* and descending portion 24*a*), the falling prevention units 20*b*, 20*a*, the first support release unit 22*b*, and the second support release unit 22*a*.

If the common rotation shaft 28 rotates (clockwise in FIG. 10), then the common rotation shaft 28 rotates counterclockwise in FIG. 5(*a*), the descending portion 24*a* descends, thereby pulling the second support release unit 22*a*, and the second support release unit 22*a* rotates clockwise in FIG. 13, thereby pulling the fall prevention unit 20*a*, resulting in the activation of the second support release unit 22*a*. The fall prevention unit 20*a* is thus detached from the gate 10 (refer to FIG. 12).

In this way, the surfacing of the first float 18 ("surfacing" does not necessarily requires the exposure of the top end from the water surface, and also includes a movement of the top end toward the water surface) activates the first support release unit 22*b* and the second support release unit 22*a*.

FIG. 12 is a plan view transparently viewing neighborhoods of the fall prevention units 20*a*, 20*b* while the gate 10 is fallen down. The fall prevention units 20*a*, 20*b* have been released from the gate 10, and the gate 10 thus falls down toward the downstream side by the water pressure of the sewage W.

Figure 14:
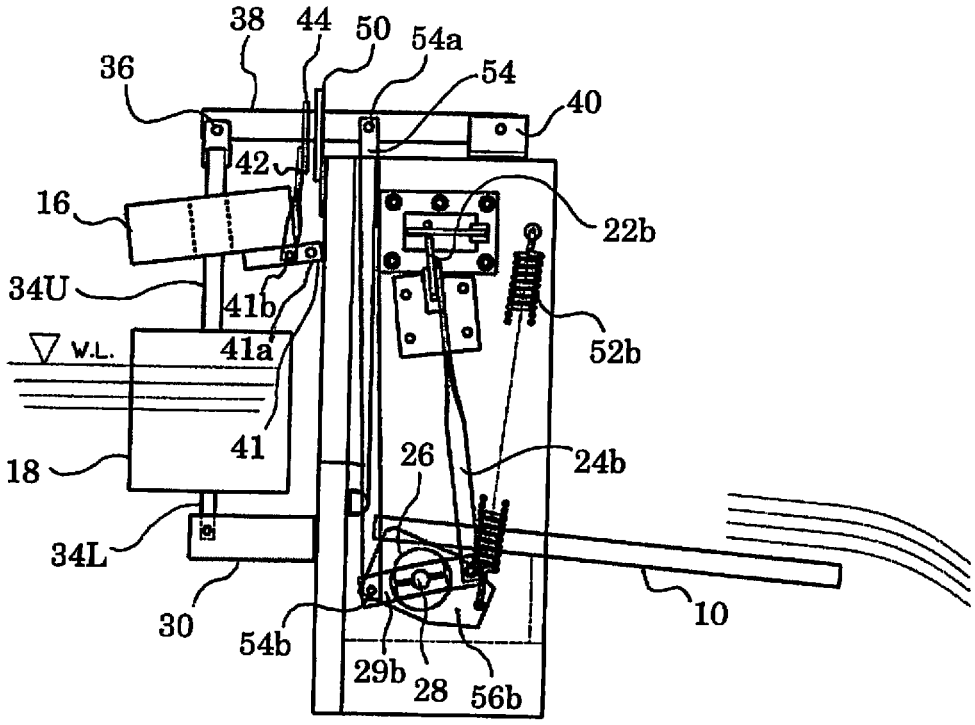
FIG. 14 is a right side view of the opening/closing device 1 after the sewage W has flown toward the downstream side.

FIG. 14 is a right side view of the opening/closing device 1 after the sewage W has flown toward the downstream side. If the water level is decreased below the bottom end of the second float 16 by the flow of the sewage W toward the downstream side and the like, the first float 18 descends while floating on the water surface of the sewage W. As a result, the suspension member 38 returns to the horizontal position. Moreover, the second float 16 descends, the connection point 41*b* descends, and the surfacing prevention unit 44 returns to the original position for pressing the suspension member 38 (refer to FIG. 6).

According to the embodiment of the present invention, even if the first float 18 is submerged in the sewage W, the float prevention portion 44 still presses the suspension member 38 until the second float 16 surfaces (refer to FIG. 6), and the first float 18 thus cannot surface.

On this occasion, if the second float 16 surfaces quickly, the surfacing prevention unit 44 rotates accordingly, and does not press the suspension member 38 any more (refer to FIG. 11), and the first float 18 starts surfacing quickly (the first float 18 has already been submerged, and a large buoyant force is acting on the first float 18). As a result, the suspension member 38 rotate clockwise about the fulcrum 40 of the suspension member 38 in FIG. 10, the link 54 ascends accordingly, the rotation unit 29*b* rotates clockwise, the descending portion 24*b* descends, thereby pulling the first support release unit 22*b* (refer to FIG. 13), the fall prevention unit 20*b* is pulled, and the support for the gate 10 is released.

Simultaneously, the clockwise rotation of the rotation unit 29*b* in FIG. 10 causes the common rotation shaft 28 to rotate, the rotation unit 29*a* rotates (counterclockwise in FIG. 5(*a*)), the descending portion 24*a* descends, thereby pulling the second support release unit 22*a* (refer to FIG. 13), the fall prevention unit 20*a* is pulled, and the support for the gate 10 is released. Moreover, the transmission of the power by means of the pulling is beneficial in principle for the simultaneous support release for the gate 10 by the fall-down prevention units 20*a*, 20*b*.

On this occasion, the first float 18 ascends quickly, the release of the support by the fall prevention unit 20*b* for the gate 10 is thus carried out quickly, and the gate 10 can thus quickly fall down, and open.

Moreover, though the fall prevention units 20*a*, 20*b* are connected with each other by the common rotation shaft 28, the common rotation shaft 28 is arranged inside the hollow gate rotation shaft 26, the sewage W is prohibited from entering the inside of the gate rotation shaft 26, and the common rotation shaft 28 is not thus exposed to the sewage W.

Moreover, the opening/closing device 1 according to the embodiment of the present invention is configured to return to the state in which the gate 10 is standing upright after the gate 10 has fallen down and the water level of the flow passage decreases.

Figure 15:
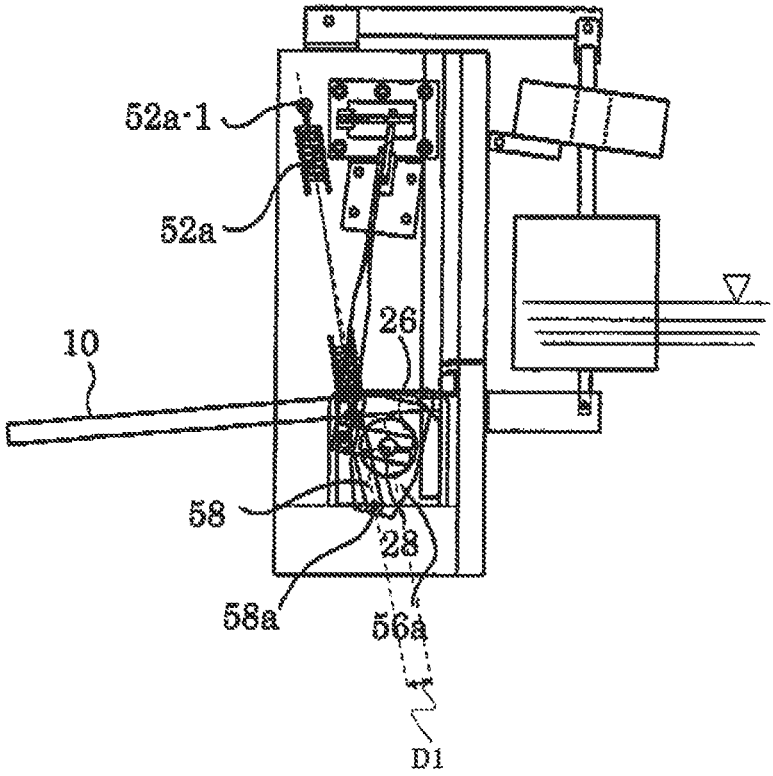
FIGS. 15(*a*) and 15(*b*) are side views of the opening/closing device 1 if the gate 10 is fallen down, and are a left side view (FIG. 15(*a*)) and a right side view (FIG. 15(*b*)) from the upstream standpoint.
Figure 15:
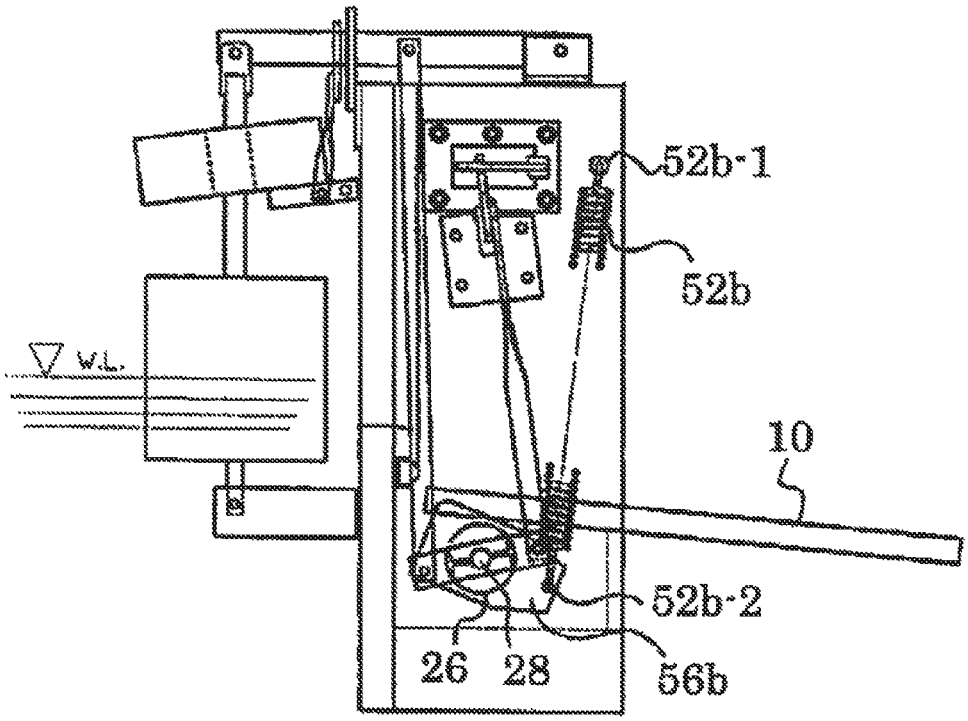

FIGS. 15(*a*) and 15(*b*) are side views of the opening/closing device 1 if the gate 10 is fallen down, and are a left side view (FIG. 15(*a*)) and a right side view (FIG. 15(*b*)) from the upstream standpoint. The opening/closing device 1 includes the first spring 52*a*, the second spring (second force generation unit) 52*b*, the link 54, and rotation bodies 56*a*, 56*b* as described before. Moreover, the opening/closing device 1 includes the link 58.

The rotation bodies 56*a*, 56*b* are fixed to the gate rotation shaft 26, and rotate along with the gate rotation shaft 26.

A first force generation unit is constructed by the first spring 52*a* and the link 58. The first spring 52*a* is fixed to one end 52*a*-1 of the first force generation unit. The link 58 is fixed to the other end 58*a* of the first force generation unit, and is coupled to the first spring 52*a*.

The one end 52*a*-1 of the first force generation unit is fixed above the gate rotation shaft 26. The other end 58*a* of the first force generation unit is fixed to the rotation body 56*a*, and is arranged at a position separated by a predetermined length from (the center of) the gate rotation shaft 26. In other words, even if the rotation body 56*a* rotates with the gate rotation shaft 26, the distance (predetermined length) between the other end 58*a* of the first force generation unit and (the center of) the gate rotation shaft 26 does not change.

The first spring 52*a* generates a force required for the gate 10 returning to the state of standing upright. It should be noted that the first spring 52*a* generates a force which is not sufficient for the gate 10 returning to the state of standing upright in the state in which the gate 10 is fallen down. Referring to FIG. 15(*a*), a distance D1 between a line connecting between the one end 52*a*-1 of the first force generation unit and the other end 58*a* of the first force generation unit and the center of the gate rotation shaft 26 (corresponding to the length of a perpendicular line from the center of the gate rotation shaft 26 to the line connecting between the one end 52*a*-1 and the other end 58*a*) is short if the gate 10 is in the fallen state. As a result, the torque for rotating the gate rotation shaft 26 clockwise in FIG. 15(*a*) is small, and the force required for bringing the gate 10 into the state of standing upright is not sufficient.

The second force generation unit includes the second spring 52*b* fixed both to one end 52*b*-1 of the second force generation unit and the other end 52*b*-2 of the second force generation unit. It is conceived that the second spring 52*b* is fixed to the one end 52*b*-1 (or the other end 52*b*-2), a link is connected to the other end 52*b*-2 (or the one end 52*b*-1), and the second spring 52*b* is connected to the link.

The one end 52*b*-1 of the second force generation unit is fixed above the gate rotation shaft 26. The other end 52*b*-2 of the second force generation unit is fixed to the rotation body 56*b*, and is arranged at a position separated by a predetermined length from (the center of) the gate rotation shaft 26. In other words, even if the rotation body 56*b* rotates with the gate rotation shaft 26, the distance (predetermined length) between the other end 52*b*-2 of the second force generation unit and (the center of) the gate rotation shaft 26 does not change.

A distance D2 between a line connecting between the one end 52*b*-1 of the second force generation unit and the other end 52*b*-2 of the second force generation unit and the center of rotation of the gate rotation shaft 26 (corresponding to the length of a perpendicular line from the center of the gate rotation shaft 26 to the line connecting between the one end 52*b*-1 and the other end 52*b*-2) is shorter than the distance D1 in the state in which the gate 10 is fallen down. However, the second spring 52*b* is longer than the first spring 52*a* (smaller in spring constant), and the torque for the counterclockwise rotation in FIG. 15(*b*) is small.

There is provided such a configuration as generating a force sufficient for starting to bring the gate 10 into the upright state by adjusting the distance D2 and the length of contracting the second spring 52*b* if the water level of the flow passage through which the fluid (sewage W) flows is equal to or less than a predetermined water level. The configuration does not generate a force sufficient for starting to bring the gate 10 into the upright state even if the water level of the flow passage is still high due to the force of the second spring 52*b* being too large.

Then, if the water level becomes equal to or less than a predetermined water level, the gate rotation shaft 26 is rotated by the contractile force of the second spring 52*b*, thereby slightly raising the gate 10.

Figure 16:
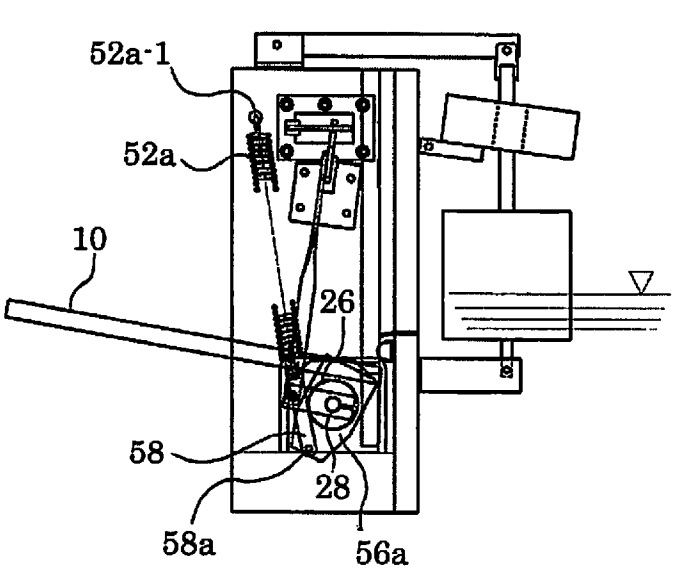
FIGS. 16(*a*) and 16(*b*) are side views of the opening/closing device 1 if the gate 10 is slightly raised, and are a left side view (FIG. 16(*a*)) and a right side view (FIG. 16(*b*)) from the upstream standpoint.
Figure 16:
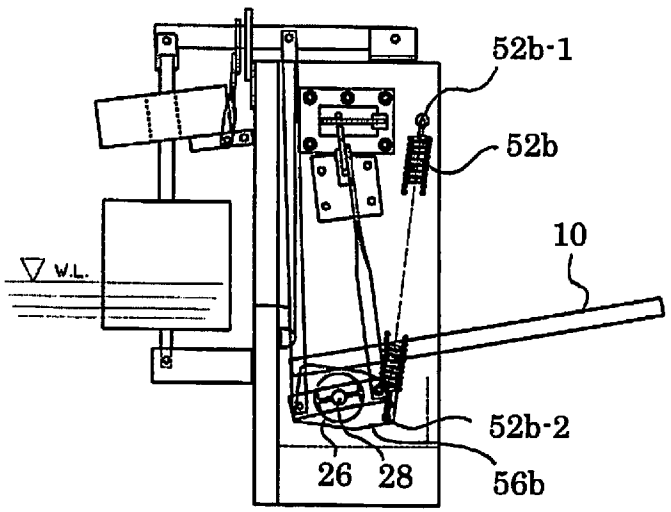

FIGS. 16(*a*) and 16(*b*) are side views of the opening/closing device 1 if the gate 10 is slightly raised, and are a left side view (FIG. 16(*a*)) and a right side view (FIG. 16(*b*)) from the upstream standpoint.

Referring to FIG. 16(*a*), a distance between the line connecting between the one end 52*a*-1 of the first force generation unit and the other end 58*a* of the first force generation unit and the center of the gate rotation shaft 26 is still short if the gate 10 is slightly raised. The torque generated by the first spring 52*a* for rotating the gate rotation shaft 26 clockwise (torque for raising the gate 10) is still small.

Referring to FIG. 16(*b*), a distance between the line connecting between the one end 52*b*-1 of the second force generation unit and the other end 52*b*-2 of the second force generation unit and the center of the gate rotation shaft 26 is still long if the gate 10 is slightly raised. Therefore, the torque generated by the second spring 52*b* for rotating the gate rotation shaft 26 counterclockwise (torque for raising the gate 10) is still sufficient for raising the gate 10.

The gate 10 further rises.

Figure 17:
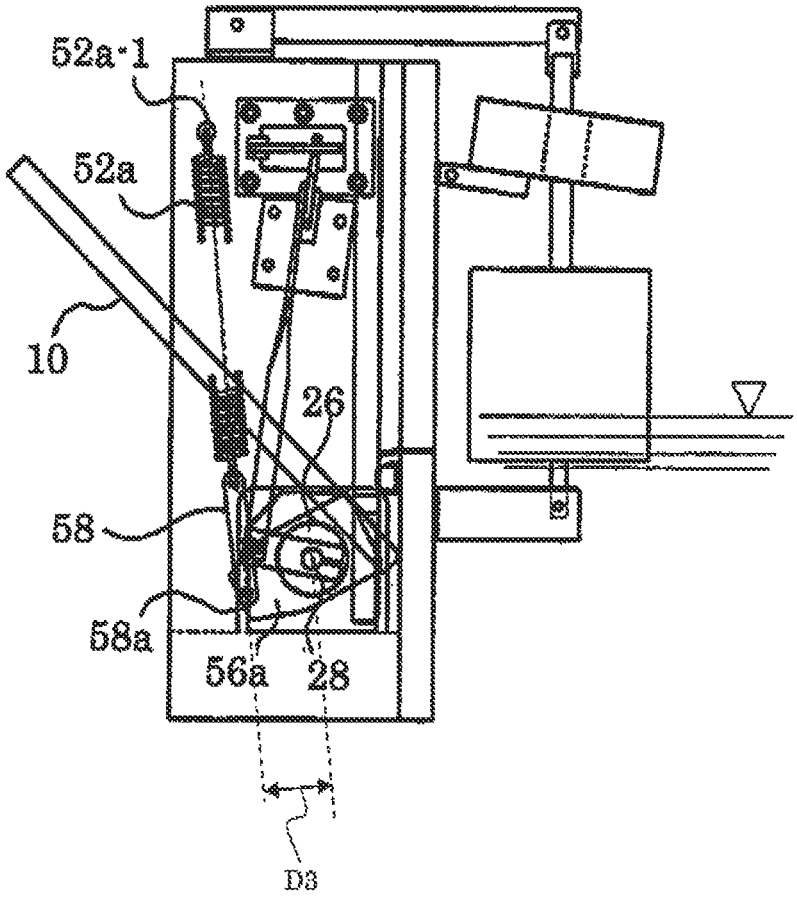
FIGS. 17(*a*) and 17(*b*) are side views of the opening/closing device 1 if the gate 10 is further raised, and are a left side view (FIG. 17(*a*)) and a right side view (FIG. 17(*b*)) from the upstream standpoint.
Figure 17:
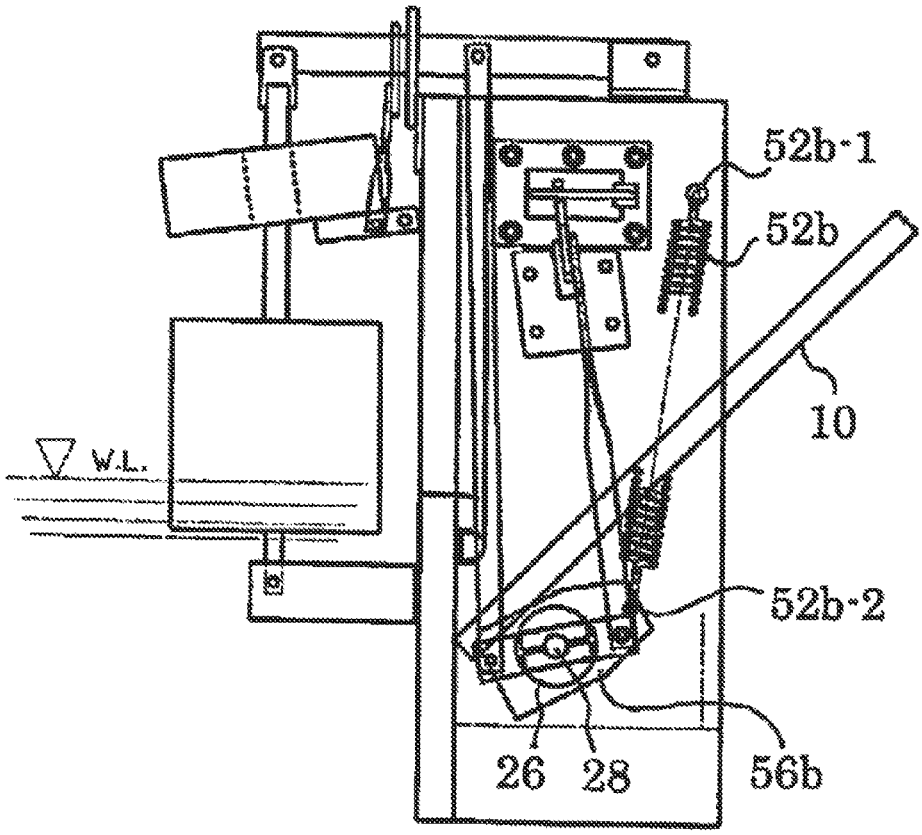

FIGS. 17(*a*) and 17(*b*) are side views of the opening/closing device 1 if the gate 10 is further raised, and are a left side view (FIG. 17(*a*)) and a right side view (FIG. 17(*b*)) from the upstream standpoint.

Referring to FIG. 17(*a*), a distance D3 between the line connecting between the one end 52*a*-1 of the first force generation unit and the other end 58*a* of the first force generation unit and the center of the gate rotation shaft 26 is long if the gate 10 is tilted at a predetermined angle. In other words, the distance D1 between the line connecting between the one end 52*a*-1 of the first force generation unit and the other end 58*a* of the first force generation unit and the center of the gate rotation shaft 26 in the state in which the gate 10 is fallen down (refer to FIG. 15(*a*)) is shorter than the distance D3. This holds true for a case in which the gate 10 is tilted at an angle less than the predetermined angle (the gate 10 stands more upright than in FIG. 17(*a*)). Therefore, the first spring 52*a* generates a force sufficient for bringing the gate 10 into the state of standing upright if the gate 10 is tilted at an angle less than the predetermined angle. In other words, the torque generated by the first spring 52*a* for rotating the gate rotation shaft 26 clockwise (torque for raising the gate 10) is sufficiently large for bringing the gate 10 into the state of standing upright.

Referring to FIG. 17(*b*), a distance between the line connecting between the one end 52*b*-1 of the second force generation unit and the other end 52*b*-2 of the second force generation unit and the center of the gate rotation shaft 26 becomes rather short if the gate 10 is further raised. Therefore, the torque generated by the second spring 52*b* for rotating the gate rotation shaft 26 counterclockwise (torque for raising the gate 10) slightly decreases.

The gate 10 finally returns to the upright state.

Figure 18:
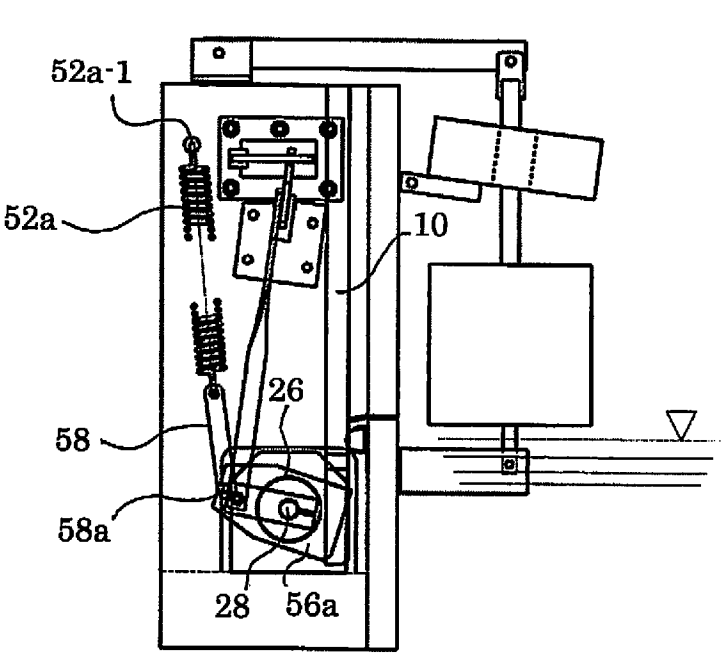
FIGS. 18(*a*) and 18(*b*) are side views of the opening/closing device 1 if the gate 10 stands upright, and are a left side view (FIG. 18(*a*)) and a right side view (FIG. 18(*b*)) from the upstream standpoint.
Figure 18:
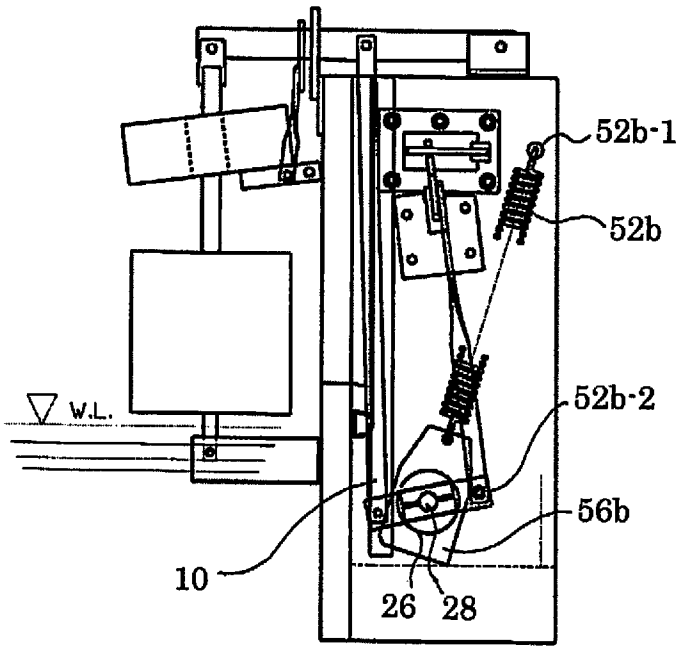

FIGS. 18(*a*) and 18(*b*) are side views of the opening/closing device 1 if the gate 10 stands upright, and are a left side view (FIG. 18(*a*)) and a right side view (FIG. 18(*b*)) from the upstream standpoint.

Referring to FIG. 18(*a*), the torque generated by the first spring 52*a* for rotating the gate rotation shaft 26 clockwise is large.

Referring to FIG. 18(*b*), the gate rotation shaft 26 is present on the line connecting between the one end 52*b*-1 of the second force generation unit and the other end 52*b*-2 of the second force generation unit, and the torque generated by the second spring 52*b* for rotating the gate rotation shaft 26 counterclockwise is approximately zero.

According to the embodiment of the present invention, if the gate 10 is fallen down (refer to FIG. 15(*a*)), the torque generated by the first spring 52*a* having the large spring constant for bringing the gate 10 into the state of standing upright is small, and it is possible to prevent the gate 10 from closing if the water level of the flow passage is still high.

Moreover, the first spring 52*a* generates a force sufficient for bringing the gate 10 into the state of standing upright if the gate 10 is tilted at an angle equal to or less than the predetermined angle (refer to FIG. 17(*a*)). Thus, it is possible to bring the gate 10 into the state of standing upright.

Further, if the gate 10 is fallen down (refer to FIG. 15(*b*)), and the water level of the flow passage through which the fluid (sewage W) flows is lower than the predetermined water level, it is possible to start bringing the gate 10 into the state of standing upright by the second spring 52*b* which is configured to generate the force sufficient for starting to bring the gate 10 into the state of standing upright.

The invention claimed is:

1. An opening/closing device comprising:

a gate that receives a flow of a fluid, and can fall toward a downstream side of the flow;

a fall prevention unit that prevents the gate from falling by supporting the gate;

a support release unit that releases a support for the gate by the fall prevention unit;

a first float that is arranged on the upstream side of the gate, and is constructed to have a lesser value of specific gravity than the fluid;

a surfacing-prevention unit that prevents the first float from surfacing;

a second float that is arranged on the upstream side of the gate, is arranged above the first float, and is constructed to have a lesser value of specific gravity than the fluid; and a surfacing-prevention release unit that releases, resulting from surfacing of the second float, the prevention of the surfacing of the first float by the surfacing prevention unit, wherein the support release unit is activated resulting from surfacing of the first float.

2. The opening/closing device according to claim 1, wherein the fall prevention unit supports a surface on a downstream side of the gate.

3. The opening/closing device according to claim 1, wherein the support release unit releases the support for the gate by pulling the fall prevention unit toward an outside of the flow.

4. The opening/closing device according to claim 1, comprising a suspension member that suspends the first float, and includes an ascending portion which ascends resulting from the surfacing of the first float, wherein the surfacing prevention unit includes:

an abutting portion that is located above the suspension member, and abuts against the suspension member if the ascending portion of the suspension member ascends; and a fixing portion which rotatably fixes the abutting portion to a portion which is stationary with respect to the flow.

5. The opening/closing device according to claim 4, wherein:

the surfacing prevention unit includes a rotatable portion which can rotate about the fixing portion, wherein the abutting portion rotates by an angle by which the rotatable portion rotates; and the surfacing-prevention release unit includes a drive unit that moves the rotatable portion resulting from the surfacing of the second float.

6. The opening/closing device according to claim 4, comprising a descending portion that is coupled to the suspension member, and descends resulting from the ascent of the ascending portion of the suspension member, wherein:

the support release unit releases the support for the gate by pulling the fall prevention unit toward an outside of the flow; and the support release unit is coupled to the descending portion, and pulls the fall prevention unit toward the outside of the flow in response to a descent of the descending portion.

* * * * *

UNITED STATES PATENT AND TRADEMARK OFFICE

CERTIFICATE OF CORRECTION

PATENT NO. : 8,590,560 B2
APPLICATION NO. : 13/147345
DATED : November 26, 2013
INVENTOR(S) : Komatsu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 246 days.

Signed and Sealed this
Twenty-second Day of September, 2015

Michelle K. Lee

Michelle K. Lee
*Director of the United States Patent and Trademark Office*